United States Patent [19]

Bardin et al.

[11] Patent Number: 4,577,887

[45] Date of Patent: Mar. 25, 1986

[54] SAFETY SKI BINDING

[75] Inventors: Roland Bardin, Varennes Vauzelles; Jean Bernard; Henri Peyre, both of Nevers; Patrice Viodet, Imphy, all of France

[73] Assignee: Ste Look, Nevers, France

[21] Appl. No.: 615,767

[22] Filed: May 31, 1984

[30] Foreign Application Priority Data

Jun. 27, 1983 [FR] France ..... 83 10554

[51] Int. Cl.[4] ..... A63C 9/08

[52] U.S. Cl. ..... 280/628

[58] Field of Search ..... 280/626, 628, 629, 623

[56] References Cited

U.S. PATENT DOCUMENTS

| | | | |
|---|---|---|---|
| 3,876,219 | 4/1975 | Smolka et al. | 280/628 |
| 4,243,246 | 1/1981 | Weigl | 280/628 |
| 4,298,213 | 11/1981 | Storandt | 280/628 |
| 4,337,965 | 7/1982 | Salomon | 280/628 |
| 4,508,361 | 4/1985 | Svoboda et al. | 280/628 |

FOREIGN PATENT DOCUMENTS

| | | |
|---|---|---|
| 2275232 | 1/1976 | France . |
| 2395046 | 1/1979 | France . |
| 2469189 | 5/1981 | France . |

*Primary Examiner*—David M. Mitchell
*Assistant Examiner*—Michael Mar
*Attorney, Agent, or Firm*—Young & Thompson

[57] ABSTRACT

The safety ski binding is primarily intended to retain the toe end of a ski boot and comprises a yoke pivotally mounted on a cross-pin in a stationary hollow body. The jaw unit for retaining the ski boot is guided in longitudinal sliding motion within the yoke. The jaw unit is provided with semi-cylindrical grooves directed towards the ski boot and having the function of cooperating with support rods attached to the yoke. The jaw unit is also associated with a cylindrical roller which is directed away from the ski boot and is intended to cooperate with a locking lever. The ski binding provides compensation for the parasitic friction forces which arise from complex falling movements involving forward-fall and twisting motion as well as backward-fall and twisting motion.

12 Claims, 26 Drawing Figures

SAFETY SKI BINDING

This invention relates to a safety toe-abutment device for skis.

Modern safety ski bindings are usually made up of two elements for retaining the boot on the ski, namely a toe-abutment device which is adapted to cooperate with the toe end of the ski boot and a heel-holding device which is either of a conventional type or of the pivot type and is adapted to cooperate with the heel end of the ski boot.

The toe-abutment device permits lateral disengagement of the ski boot when an excessive torsional stress is applied to the skier's leg. The heel-holding device (or the pivot) permits vertical disengagement of the ski-boot heel when the leg is subjected to an excessive forward-bending stress.

The majority of toe-abutment devices at present on the market have considerable elasticity and are consequently endowed with high impact strength, thus making it possible to use them at relatively low values of stiffness of release without giving rise to accidental trips. Furthermore, these devices are equipped with antifriction linings which reduce the friction forces developed in the zones of contact of the boot with the ski and with the ski binding. These devices accordingly achieve a satisfactory standard of safety in trips resulting from simple torsional stresses.

On the other hand, when a fall does not occur solely in simple torsion as is most frequently the case, parasitic friction forces are developed. Although attenuated by the aforementioned antifriction linings, these friction forces inhibit normal release of the abutment device and consequently increase the potential danger of injury.

Parasitic friction forces are particularly strong during combined forward-fall and twisting movements in which loss of balance experienced by the skier in the forward direction produces excess pressure of the metatarsal or front end of the foot against the ski as well as a longitudinal thrust of the ski boot within the jaw unit of the toe-abutment device, particularly with some types of heel-holding devices.

In the event of a combined backward and torsional fall, parasitic friction forces are set up between the top edge of the ski-boot sole and the underface of the toe-abutment jaw unit.

In order to solve these problems, a number of different solutions have already been proposed. Reference may accordingly be made to French patents No. 2,395,046, No. 2,275,232 and No. 2,469,189 in which the present state of the art is clearly apparent. These patents will now be discussed in brief outline.

French patent No. 2,395,046 discloses a toe-abutment device in which the boot-retaining jaw unit is so arranged as to be capable not only of undergoing a lateral movement of pivotal displacement about a vertical axis but also of longitudinal sliding motion along the ski. In the event of a forward fall, the jaw unit is thrust forward and thus permitted to pivot freely in a lateral direction. This system consequently achieves automatic compensation for the parasitic friction forces set up by a forward fall and ensures that the overall stiffness of release under torsional stress remains practically constant.

Unfortunately this toe-abutment device does not provide a solution to the problem of combined backward-fall and twisting movements.

French patent No. 2,275,232 relates to a safety ski binding in which a heel-retaining jaw unit, also known as a heel clamp, allows disengagement of the heel of the boot both in the lateral direction and in the vertical direction. The forms of construction shown in FIGS. 1 to 3 of the cited patent comprise a stationary hollow body, a yoke pivoted on the body about a horizontal axis which is transverse to the ski and a jaw unit pivoted about a vertical axis. A locking lever housed within the hollow body and pivoted about a horizontal axis transverse to the ski is urged by a spring to produce action by means of a ramp in order to prevent upward displacement of the assembly consisting of yoke and jaw unit. Said jaw unit is secured against rotation with respect to the yoke by means of a ball catch. The arrangement is such that the force required to release the ball catch decreases when the jaw unit undergoes an upward displacement.

This system consequently provides compensation for parasitic friction forces arising from vertical traction applied by the ski boot on the jaw unit but fails to provide compensation in the event of longitudinal thrust of the ski boot within the jaw unit. Furthermore, a ball-catch system of the type provided for rotational locking of the jaw unit with respect to the yoke has a low degree of elasticity and would therefore not be suitable for a modern ski binding.

French patent No. 2,469,189 (granted to the present Applicant) relates to a toe-abutment member provided with a compensation device which operates in the two cases of combined forward-twist and backward-twist falling movements. This toe-abutment member comprises a feeler member which is independent of its boot-retaining jaw unit and is adapted to be in contact with the front end portion of the ski boot. This feeler member is so designed as to produce action on the resilient boot-release system in order to reduce the inherent stiffness of this system both under a longitudinal thrust and at the time of a lifting force applied on the jaw unit. This device operates satisfactorily on condition, however, that perfect contact has been established beforehand in three zones between the ski boot and the binding, namely two zones of contact with the jaw-unit arms and one zone of contact with the feeler member. If the arms of the jaw unit are applied too tightly against the boot, the feeler member is not displaced to a sufficient extent. On the other hand, if the arms are too widely spaced, the clearance which thus appears is not conducive to good ski control. It is therefore necessary to carry out a preliminary width adjustment of the toe-abutment device in order to adapt this latter to the shape of the toe end of the ski boot. This operation consists in screwing or unscrewing the arm-adjusting screws (designated by the reference 7 in FIGS. 1 and 2) to a greater or lesser extent and has to be carried out by a sports equipment dealer after the binding has been mounted on the ski. Unfortunately, for reasons of lack of time or attention, the dealer may fail to make a correct adjustment and the system consequently loses part of its effectiveness.

Moreover, in the form of construction shown in FIGS. 1 to 6 of the cited patent, an accumulation of caked snow beneath the ski boot results in total freedom of rotation of the jaw unit about its axis. This freedom of rotational displacement is admittedly limited to a relatively short distance of travel but nevertheless results in sideslip displacements of the foot with respect to the ski, which is regarded as an objectionable defect by good skiers. The form of construction of FIGS. 7 to 10 does offer a remedy for this drawback but at the cost of a substantial technical complication involving the use of two separate resilient systems, thus making this solution commercially unacceptable.

The aim of the present invention is to overcome the disadvantages set forth in the foregoing and to propose a toe-abutment device which ensures compensation for parasitic friction forces developed both during combined forward-fall and twisting movements and during combined backward-fall and twisting movements, which has a jaw unit so designed as to require no width adjustment, which does not give rise to any sideslip displacements or "wobbling" of the boot with respect to the ski in the event of accumulation of caked snow beneath the sole, and which is of simple design and is also inexpensive to manufacture.

To this end, the toe-abutment device in accordance with the invention comprises (as in the case of the ski binding disclosed in French patent No. 2,275,232 cited earlier) a hollow body to be mounted on the ski, a yoke pivoted on said body about a horizontal cross-pin which extends transversely with respect to the ski, a boot-retaining jaw unit carried by the yoke and capable of lateral pivotal displacement on each side of the axis of the ski, a locking lever mounted within said body and pivoted about a horizontal cross-pin which extends transversely with respect to the ski, a spring housed within said body and adapted to produce action in opposition to the locking lever so as to ensure that said lever prevents lateral pivotal displacement of the jaw unit while at the same time preventing upward displacement of the assembly consisting of jaw unit and yoke by means of a guide ramp. The distinctive feature of the toe-abutment device in accordance with the invention lies in the fact that the jaw unit is guided within the yoke so as to slide within this latter in the longitudinal direction of the ski and that said jaw unit is normally maintained stationary and prevented from moving in a lateral direction by two bearing means which are associated with said jaw unit and comprise:

- a first bearing means provided with a vertical opening directed toward the ski boot and adapted to cooperate with a first complementary support which is rigidly fixed to the yoke; and
- a second bearing means directed away from the ski boot and adapted to cooperate with a second complementary support which is rigidly fixed to the locking lever.

Thus in the event of a simple twisting movement, the two bearing means come into action in order to determine the stiffness of release. On the other hand, in the event of a combined forward-fall and twisting movement, the longitudinal thrust exerted by the ski boot on the jaw unit has the effect of moving the first bearing means away from its complementary support, thus endowing the jaw unit with a predetermined degree of freedom of pivotal displacement which achieves the desired compensation for parasitic friction forces.

In accordance with a particularly advantageous additional feature of the invention, the toe-abutment device is provided with a third movable support which is urged by the spring toward the jaw unit and is smaller in width than the second support. Said third support is adapted to cooperate with a third bearing means mounted in fixed relation to the jaw unit when the assembly consisting of jaw unit and yoke is upwardly displaced under the action of a vertical force.

Thus in the event of a combined backward-fall and twisting movement, the third bearing means comes into action in place of the second bearing means in order to determine the stiffness of release. By virtue of its smaller width, said third bearing means achieves the desired compensation for parasitic friction forces.

Other features of the invention will be more apparent upon consideration of the following description and accompanying drawings, wherein.

Figure 1:
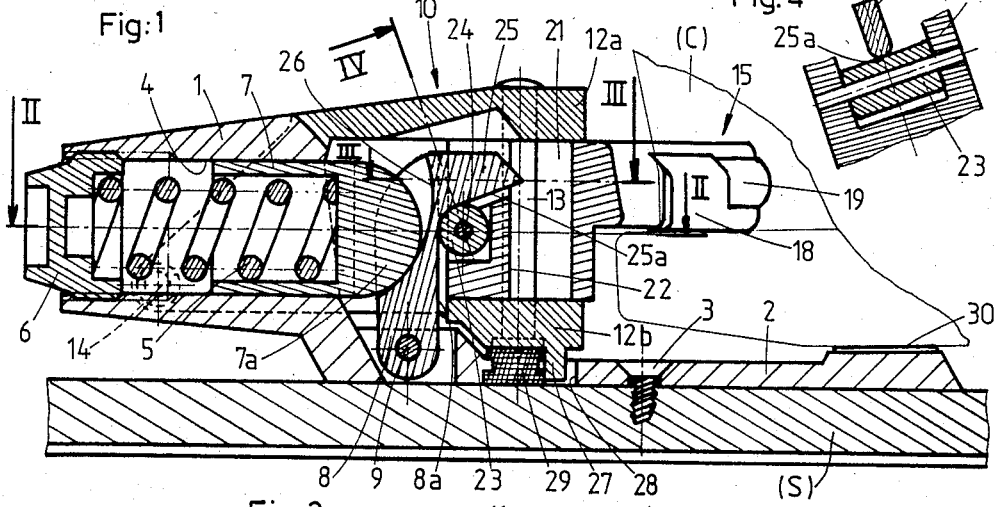
FIG. 1 is a front view of a first embodiment of a toe-abutment device in accordance with the invention, this view being taken in section along the vertical plane I—I of FIG. 2.
Figure 4:
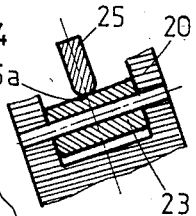
FIG. 4 is a sectional view showing a detail of FIG. 1 (section plane IV)
Figure 3:
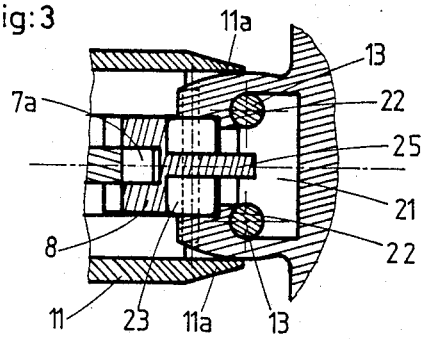
FIG. 3 is a fragmentary top view taken in section along the horizontal plane III—III of FIG. 1.

The first embodiment of FIGS. 1 to 9 comprises a hollow body 1 having a base plate 2 which is fixed on the top face of the ski (S) by means of screws 3. The pointed front tip of the ski is located on the left-hand side of the figures.

The hollow body 1 has the shape of a barrel traversed by a cylindrical bore 4, the axis of which extends horizontally in the longitudinal direction of the ski. Within the bore 4 is housed a resilient system consisting of a helical compression spring 5, an externally-threaded adjustment end-cap 6 which serves as a support for the spring, and a sliding piston 7 actuated by the spring. The base plate 2 is adapted to carry a horizontal crosspin 9 on which is pivotally mounted an elbowed locking lever 8. The toe-abutment device further comprises a yoke 10 made up of two vertical side-plates 11 connected to each other by means of top and bottom horizontal crossmembers 12*a* and 12*b*. Two cylindrical rods 13 disposed vertically and symmetrically with respect to the axis of the ski are attached at each end to the cross-members 12*a*, 12*b* and connect these latter, thus performing much the same function as spacer members. The side-plates 11 are placed on each side of the barrel of the hollow body 1 and are pivotally mounted on lateral pivots 14. Said pivots are carried by said body and define a horizontal axis which is transverse to the ski.

The jaw unit 15 which serves to retain the toe end of the ski boot comprises a pair of lateral arms 16 which constitute a single-piece U-shaped member, the open side of which is directed toward the ski boot (C) shown in thin outline in the figures. Each arm 16 is fitted with a slip lining 18 having a low coefficient of friction and with a guide roller 19. The portion 20 of the jaw unit, or jaw-unit extension, which is directed toward the front end of the ski has a thickness equal to the distance between the cross-members 12*a*, 12*b* of the yoke 10. Said jaw-unit extension is provided with a vertical opening 21 having an approximately rectangular contour and is mounted within the yoke 10 in a position such that the rods 13 pass through the opening 21. The dimensions of this opening are such as to allow a small clearance between its side walls and the rods 13. This clearance endows the jaw unit with a limited degree of freedom of longitudinal sliding motion between the cross-members 12*a*, 12*b* of the yoke as well as a limited degree of freedom of lateral pivotal displacement. The front wall of the opening 21 has two semi-cylindrical grooves 22 which serve as bearing zones for the rods 13.

When seen from above, the jaw-unit extension 20 has cylindrical lateral edges against which are applied the beveled and slightly flexible rear edges 11*a* of the side plates 11 with a view to achieving a certain degree of fluid-tightness of the mechanisms housed within the yoke 10 and within the hollow body 1.

The front face of the jaw-unit extension 20 is adapted to carry a horizontal cross-pin 24 on which is rotatably mounted a cylindrical roller 23. Above the roller 23, the jaw-unit extension 20 is recessed in order to leave a free space for the beak-shaped elbowed end 25 of the lever 8. Said beak-shaped end 25 is of much smaller thickness than the remainder of the lever 8 and has a rounded edge 25*a* as is shown particularly clearly in FIGS. 3 and 4.

The front portion of the lever 8 is hollowed-out so as to form a vertical recess 26 having an arcuate bottom wall. The piston 7 has a nose 7*a* in the form of a rib having a semi-cylindrical contour, the thickness of which corresponds to the width of the recess 26. The radius of curvature of the nose 26 is smaller than that of the bottom of the vertical recess.

The underface of the cross-member 12*b* of the yoke 10 is provided with a force-transmission lug designated by the reference numeral 27 and intended to penetrate into a hole 28 of the fixed base plate 2. In said base plate is housed a synthetic rubber buffer 29 which projects to a slight extent above the top face of the base plate 2. Said buffer is located beneath the horizontal cross-member 12*b*.

In accordance with known practice, the base plate 2 is fitted in addition with a slide plate 30 for supporting the toe end of the ski-boot sole.

Figure 2:
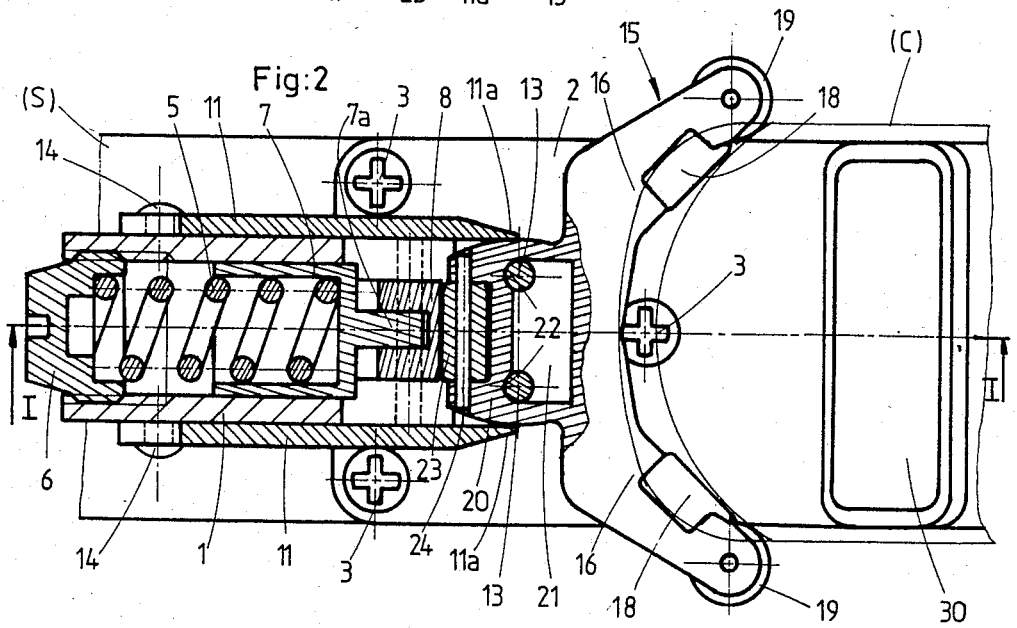
FIG. 2 is a top view taken in section along the horizontal plane II—II of FIG. 1.

When the toe-abutment device is in the normal position shown in FIGS. 1 and 2, the spring 5 actuates the piston 7. By means of the nose 7*a*, said piston 7 penetrates into the recess 26 and thrusts back the elbowed lever 8 toward the jaw unit 15. Now, the concave elbowed portion of the lever 8 is applied against the roller 23. Said lever therefore exerts an oblique force on said roller in the rearward direction (toward the right-hand side of the figures) and in a downward direction. This force therefore tends on the one hand to thrust the jaw unit 15 (which carries the roller 23) toward the ski boot and on the other hand to produce a downward pivotal displacement of the yoke 10 (to which the jaw unit is coupled in the vertical direction). Thus the bearing zones 22 of the jaw unit are applied against the rods 13 whilst the yoke cross-member 12*b* is abuttingly applied against the rubber buffer 29.

In this position, the lever 8 is in contact with the roller 23 both by means of its lower vertical face 8*a* of large width and by means of its inclined upper face 25*a* of small width.

This toe-abutment device operates as follows:

Under normal skiing conditions, the jaw unit 15 cooperates with the front portion of the ski-boot upper directly above the top edge of the sole in order to maintain the boot centered on the ski. In this position, the boot-upper is in contact with the guide rollers 19 but comes only into very light contact with the slip linings 18 since these latter are slightly set back with respect to the guide rollers on the arms 16.

Figure 5:
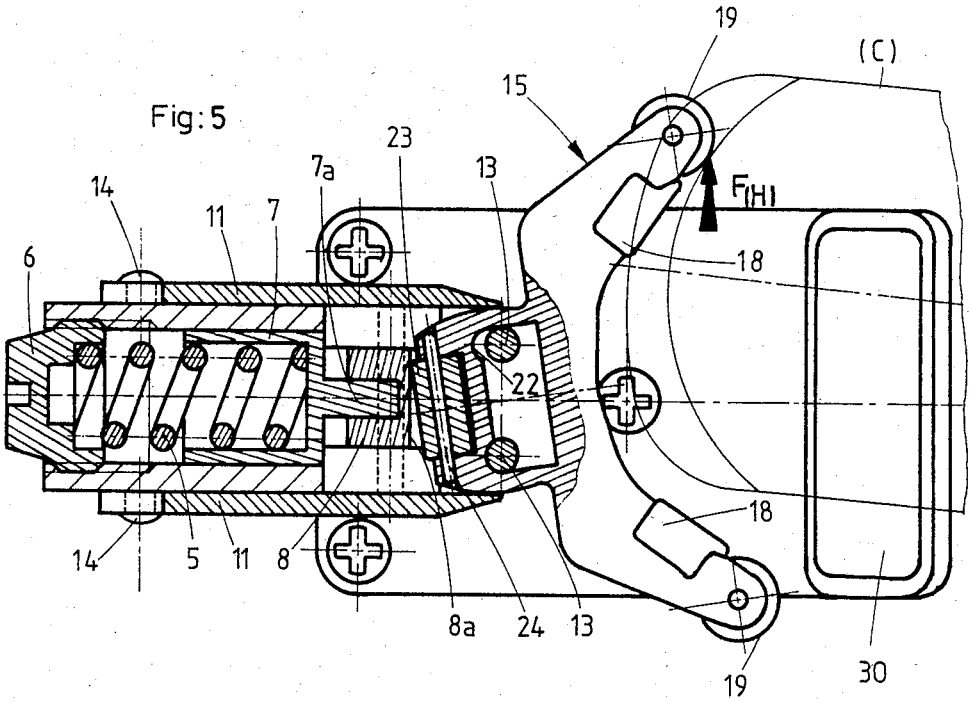
FIG. 5 is a view which is similar to FIG. 2 and shows a toe-abutment device in a position of torsional release.

When a torsional force is developed between the skier's leg and the ski, the ski boot exerts a lateral force F(H) on one of the arms of the jaw unit (as shown in FIG. 5). If this force is of high value, as is the case in particular during a fall, the jaw unit is caused to pivot about the support rod 13 located on the opposite side and the cylindrical roller 23 applies a forward thrust on the lever 8 by means of one of its circular base edges. It will be noted that these edges are rounded or chamfered in order to attenuate friction forces at this level.

The lever 8 is displaced in the forward direction and in turn applies a forward thrust on the piston 7, thus compressing the spring 5. During this movement, the bottom of the arcuate recess 26 rolls against the piston nose 7*a*, thus minimizing frictional contact between these two components.

It is worthy of note that the force which is transmitted by the spring 5 to the jaw unit 15 and tends to oppose any lateral pivotal displacement of this latter is proportional to the sum of the distance between the stop rods 13 and the width of the bearing zone in which the roller 23 is in contact with the lever 8.

Now, during a displacement in simple torsion (twisting movement alone), the lower vertical face 8*a* of substantial width of the lever 8 is thrust forward by the roller 23. In consequence, the aforesaid transmitted force which corresponds in practice to the toe-abutment release torque is of relatively high value. The force exerted by the spring is adjusted prior to use of the ski binding by screwing the end-cap 6 within the hollow body 1 to a greater or lesser extent according to the morphology and standard of proficiency of the skier.

If the force F(H) is of sufficient magnitude and duration to constitute a potential danger of injury to the skier's leg, the jaw unit undergoes a pivotal displacement through an angle such as to allow lateral disengagement of the toe end of the boot. The presence of guide rollers 19 on the arms of the jaw unit prevents this disengagement from being affected either by the state of wear of the ski boot or by any accumulation of dirt on the boot.

On the contrary, if the force F(H) is of low intensity and/or of short duration, the resilient system 5, 7 restores the jaw unit 15 to its normal position before the ski-boot is permitted to escape, thereby recentering the boot on the ski.

While skiing is in progress, it frequently occurs that the jaw unit of the toe-abutment device is subjected by the toe end of the boot to forwardly directed longitudinal thrust forces. These thrust forces appear in particular in the event that the skier is thrown off balance in the forward direction (which initiates opening of the heel-holding device) and in the event of substantial bending of the ski.

Figure 6:
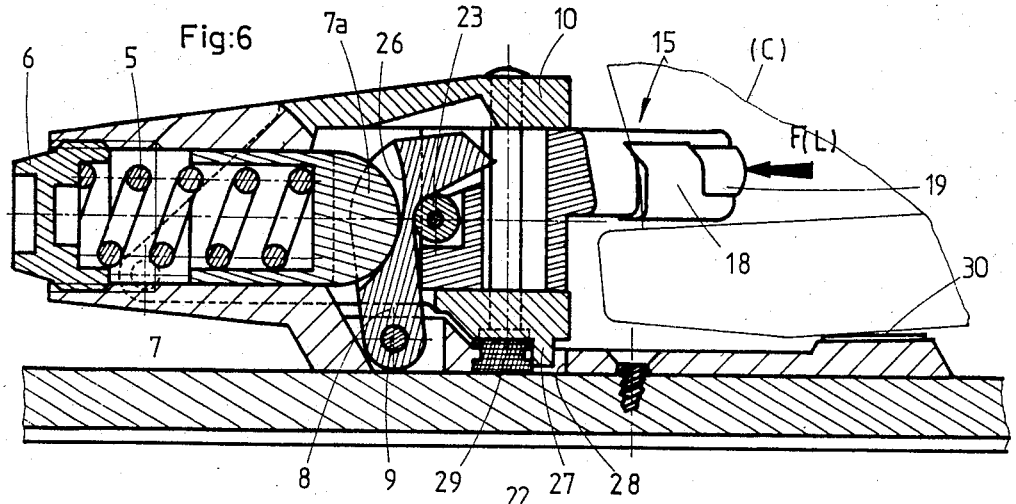
FIG. 6 is a view which is similar to FIG. 1 and shows the toe-abutment device when subjected to a longitudinal thrust.
Figure 7:
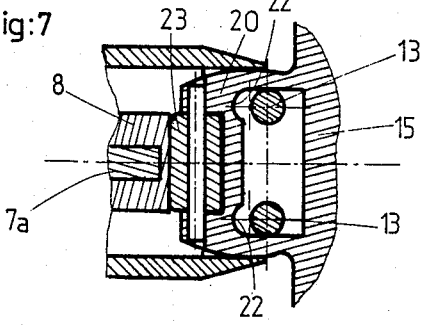
FIG. 7 is a fragmentary view which is similar to FIG. 3 and also illustrates said longitudinal thrust.

In the toe-abutment device in accordance with the invention, a longitudinal thrust force F(L) of relatively high value produces a forward displacement of the jaw unit 15 as shown in FIGS. 6 and 7. The vertical grooves 22 are consequently moved away from the support rods 13 whilst the roller 23 exerts a forward thrust on the lever 8 and on the piston 7, thus compressing the spring 5. It is apparent that, starting from the position of FIG. 7 which illustrates this situation, the jaw unit 15 is free to undergo a lateral movement of pivotal displacement to either side of the ski axis until one of the grooves 22 again encounters the associated support rod 13 (position shown in FIG. 5). By virtue of this initial freedom of pivotal displacement, the parasitic friction forces which are produced by the longitudinal stress F(L) and arise especially at the beginning of a ski-boot release (static friction forces) are virtually compensated and the stiffness of torsional release is maintained at a practically constant level in cases of combined movements of forward-fall and twisting, and twisting with ski bending.

It should be pointed out that, under the axial thrust F(L), the toe end of the ski boot has a tendency to engage tightly within the jaw unit 15 and the guide rollers 19 have a tendency to penetrate into the ski-boot upper. In some cases, ski-boot uppers are made of relatively soft material, with the result that the guide rollers are liable to be pressed into the material, thus producing a further cause of undesirable friction forces. It is in order to overcome this disadvantage that the slip linings 18 have been placed next to the guide rollers 19 and serve as boot stops for limiting the extent of penetration of the jaw unit into the ski-boot. Although straight slip linings have been contemplated in the figures, they could have an arcuate shape in order to be adapted to the curvature of the ski boot.

A further point worthy of note is that, when the jaw unit is subjected to a lateral displacement either under the action of a simple twisting movement or of a combined forward fall and twisting movement, the lug 27 cooperates with the hole 28 in order to prevent the yoke 10 from being also subjected to a lateral displacement. This makes it possible to prevent deformation of the side 11 of the yoke and frictional contact of said cheeks with the body 1.

Figure 8:
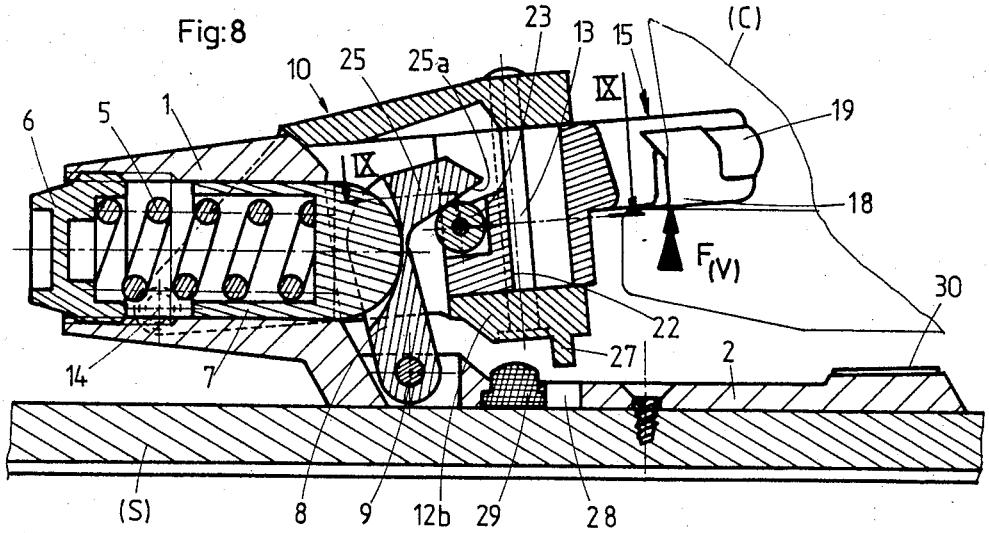
FIG. 8 is a view which is similar to FIG. 1 and shows the toe-abutment device when subjected to a backward-fall displacement.
Figure 9:
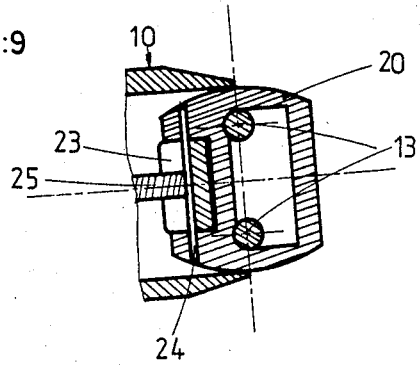
FIG. 9 shows a detail of FIG. 8 and is a top view taken in section along the staggered plane IX—IX.

FIGS. 8 and 9 illustrate the situation in which the skier is thrown off balance in the backward direction. In this situation, the top edge of the ski-boot sole exerts beneath the slip linings 18 an upwardly directed vertical force F(V). If this force is of sufficient magnitude, the assembly consisting of jaw unit 15 and yoke 10 moves upward and pivots about the pins 14. The cylindrical roller 23 runs along the upper guide ramp 25*a* of small width and exerts a forward thrust on the lever 25 and the piston 7 while compressing the spring 5.

If the force F(V) is of sufficient magnitude and duration, the jaw unit 15 moves upward over a distance of travel such that it no longer retains the ski-boot sole which is consequently permitted to disengage. After release of the ski-boot, the resilient system 5, 7 vigorously restores the assembly of yoke and jaw unit to its initial position by means of the lever 8 and guide ramp 25*a*. This movement is damped by the resilient stop 29 as this latter is struck by the lower portion 12*b* of the yoke.

By reason of the extremely small width (almost zero width) of the bearing surface of the lever 8 which is applied against the guide roller 23, the force applied by the spring 5 on the jaw unit 15 in order to prevent lateral pivotal displacement of this latter is considerably reduced in comparison with its initial value. There is thus obtained a compensation for parasitic friction forces in a combined backward-fall and twisting movement. It will be clearly understood that the same compensation will be obtained if upward displacement of the jaw unit is not caused by a skier who has lost balance in a backward direction but is caused by a caked deposit of snow beneath the ski-boot.

It should be noted that, although the force applied by the spring is lower than its initial value, its value is never reduced to zero, thus avoiding the disadvantage of side-slip displacement or "wobbling" of the boot on the ski.

Figure 10:
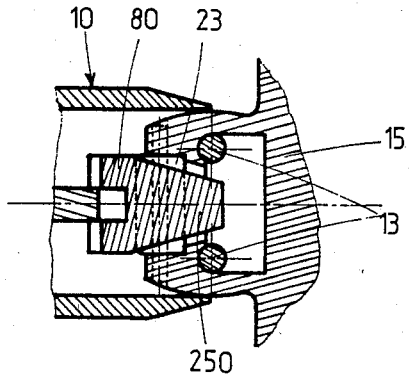
FIG. 10 is a view which is similar to FIG. 3 and shows a possible variant of the locking lever.

In the alternative embodiment illustrated in FIG. 10, the locking lever 80 has a nose 250 which has a trapezoidal shape when viewed from above.

Thus the width of the bearing surface of the roller 23 which is applied against the lever 80 and, correlatively, the toe-abutment release torque, decrease progressively as the jaw unit moves upward and not abruptly as was the case in the first embodiment of FIGS. 1 to 9.

In the second embodiment shown in FIGS. 11 to 17, most of the components are similar to if not identical with those of the first embodiment. For this reason, these components are designated by the same references as before.

This second embodiment is distinguished from the first solely by the fact that provision is made for two locking levers 40, 50 instead of only one lever. These two locking levers are pivotally mounted on the same horizontal cross-pin 9 which is mounted at a short distance above the base plate 2.

The lever 40 is of relatively small length and has a U-shaped cross-section when seen from above. This U-section lever has two arms 41 which are directed toward the rear end of the ski and has a flat front face 42.

The lever 50 is of greater length and of smaller thickness than the lever 40. Thus said lever 50 has a thickness corresponding to the distance between the arms 41 and is housed between these latter. The upper end of the lever 50 has a boss 51 which is disposed transversely. The width of the lever 50, that is to say its dimension in the longitudinal direction of the ski, is smaller in its lower portion 52 than in its upper portion 53. In consequence, the lower portion of said lever 50 is set back with respect to the arms 41 whereas its upper portion projects upward and to the rear with respect to said arms 41. The rear face of the portion 53 is designed in the form of an inclined guide ramp 54.

The piston 7 is of cylindrical shape with a flat end wall **7*b*. At its rear end, said piston is powerfully applied by the spring 5 against the face 42 of the lever 40. This lever tends to undergo a rearward pivotal displacement about its cross-pin 9 and in turn applies a thrust on the roller 23 by means of the rear faces 41*a* of the arms 41 in order to displace the jaw unit 15 in the rearward direction and to apply the grooves 22 against the rods 13**.

Figure 11:
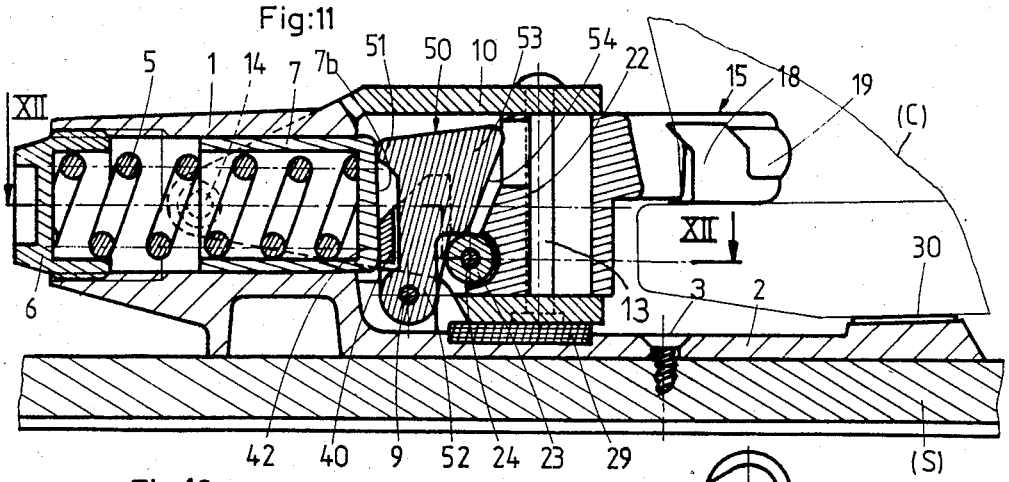
FIG. 11 is a front view of a second embodiment of a toe-abutment device in accordance with the invention, this view being taken in section along the plane XI—XI of FIG. 12.
Figure 12:
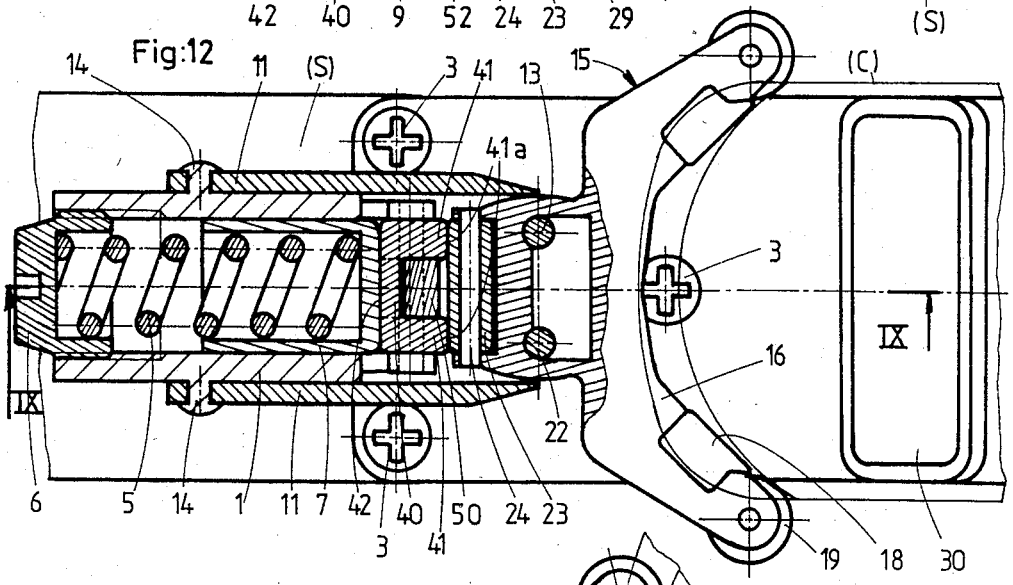
FIG. 12 is a top view taken in section along the staggered plane XII—XII of FIG. 11.

Thus the lever 50 is so dimensioned that, in the normal position shown in FIG. 11, it is positioned in very light contact with, but not applied against, on the one hand the upper portion of the piston 7 by means of the boss 51 and on the other hand the roller 23 by means of the bottom edge of the guide ramp 54.

Figure 13:
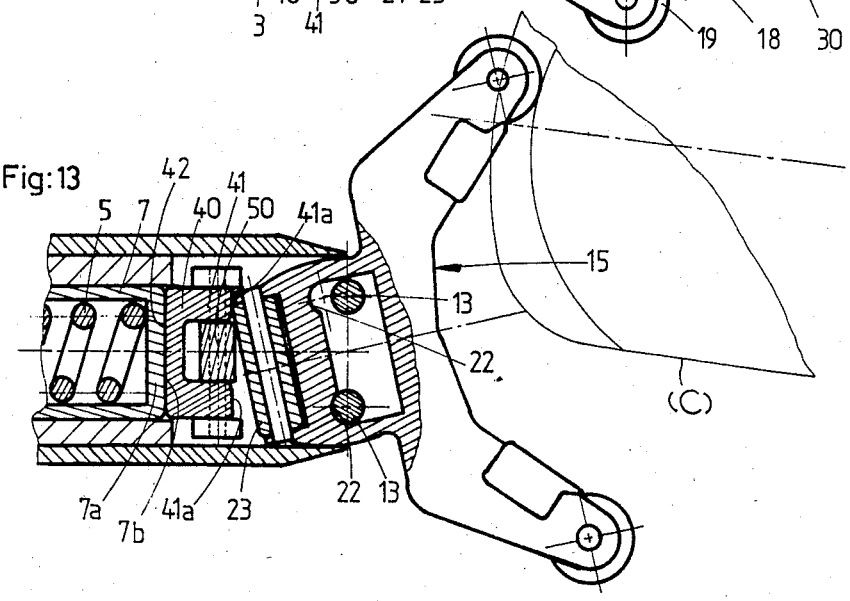
FIG. 13 is a fragmentary view which is similar to FIG. 12 and shows the toe-abutment device in a torsional release position.

In the event of a toe-abutment release under simple torsional stress as shown in FIG. 13, the jaw unit 15 pivots to one side while bearing against one of the rods 13. The roller 23 is applied against one of the faces **41*a* of the lever 40 in order to produce a forward pivotal displacement of this latter. By means of its front face 42, said lever is applied against the rear end-wall 7*b* of the piston 7 in order to cause a forward displacement of this latter within the hollow body 1 while compressing the spring. During this trip or release operation, the lever 50 does not perform any function. The stiffness of release is relatively high since the roller 23 cooperates with the lever 40** which has a substantial thickness.

Figure 14:
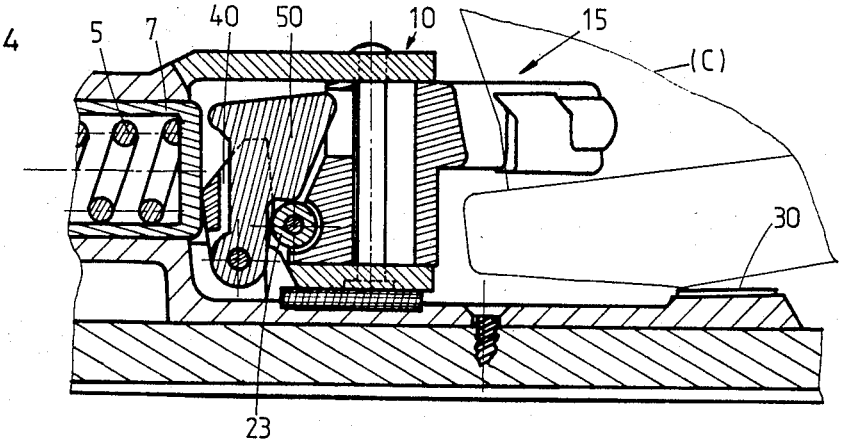
FIG. 14 is a fragmentary view which is similar to FIG. 11 and shows the toe-abutment device when subjected to a longitudinal thrust arising from a forward fall.
Figure 15:
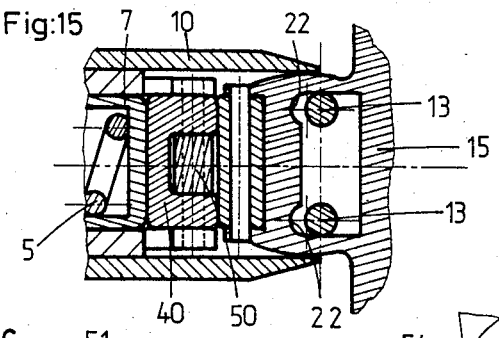
FIG. 15 is a fragmentary view which is similar to FIG. 12 and also illustrates said longitudinal thrust.

FIGS. 14 and 15 illustrate the situation which arises when the skier experiences a forward fall. The ski-boot (C) tilts forward on the slide plate 30 and exerts a forwardly directed longitudinal thrust on the jaw unit 15. Said jaw unit 15 slides forward within the yoke 10 and compresses the spring 5 by means of the roller 23, the lever 40 and the piston 7. Once again, the lever 50 does not perform any function.

As in the first embodiment, compensation for parasitic friction forces is achieved by reason of the fact that the supporting grooves 22 move away from the rods 13, thus permitting free lateral pivotal displacement of the jaw unit 15.

Figure 16:
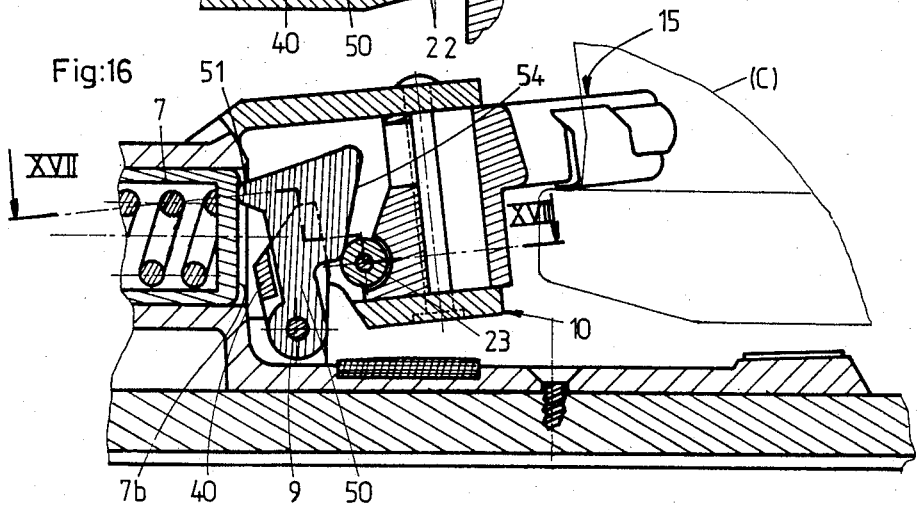
FIG. 16 is a fragmentary view which is similar to FIG. 11 and shows the toe-abutment device when subjected to a backward-fall displacement.
Figure 17:
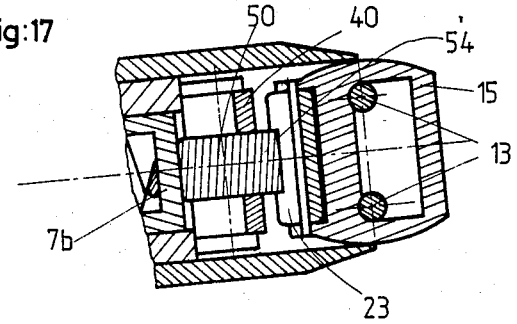
FIG. 17 is a top view taken in section along the staggered plane XVII—XVII and showing a detail of FIG. 16.

FIGS. 16 and 17 illustrate a backward-fall situation. The ski boot produces an upward displacement of the assembly consisting of jaw unit 15 and yoke 10 during which this assembly pivots about the pins 14. As soon as the roller 23 begins to move upward, it encounters the bottom edge of the guide ramp 54. The roller then passes above this edge and runs along the guide ramp 54, thus causing the lever 50 to tilt forward, said lever 50 being accompanied in its movement by the lever 40. However, by reason of its shorter length, the lever 40 loses contact with the rear face **7*b* of the piston 7. In this instance, said rear face 7*b* is thus subjected to the action of the boss 51**.

Compensation for parasitic friction forces is obtained by virtue of the fact that the roller 23 is applied against the guide ramp 54 of small thickness and no longer against the lever 40 of large thickness.

Figure 25:
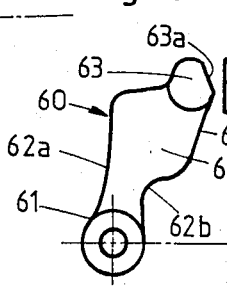
FIGS. 25 and 26 are front and left-side views respectively which illustrate the locking lever.
Figure 26:
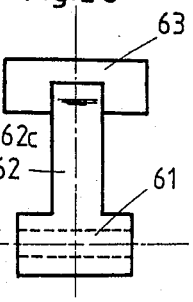

The third and last embodiment shown in FIGS. 18 to 26 is distinguished from the two preceding embodiments by its locking lever as designated by the reference 60. This lever is one-piece component comprising a lower portion in the form of a transverse cylindrical sleeve 61, a vertical body 62 of small thickness and a top portion in the form of a cross-bar 63 of relatively substantial length (as shown in FIGS. 25 and 26).

The sleeve 61 serves to mount the lever 60 for pivotal displacement on the horizontal cross-pin 9. The lever body 62 has a front face **62*a* of concave arcuate shape and a rear face having a hollowed-out portion 62*b* above which is located an inclined guide ramp 62*c***.

The top cross-bar 63 has a rearwardly-directed flat beveled face **63*a***.

A flat face **20*a* which is complementary to the beveled face 63*a* is formed on the upper portion of the front face of the central portion 20 of the jaw unit 15**.

The piston 7 is provided with a domical head **7*c***.

Figure 18:
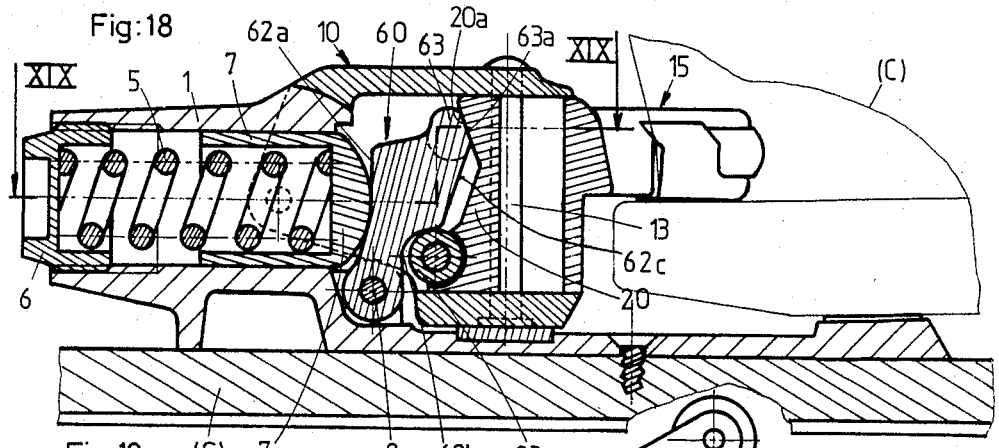
FIG. 18 is a front view of a third embodiment of a toe-abutment device in accordance with the invention, this view being taken in section along the plane of vertical symmetry XVIII—XVIII of FIG. 19.
Figure 19:
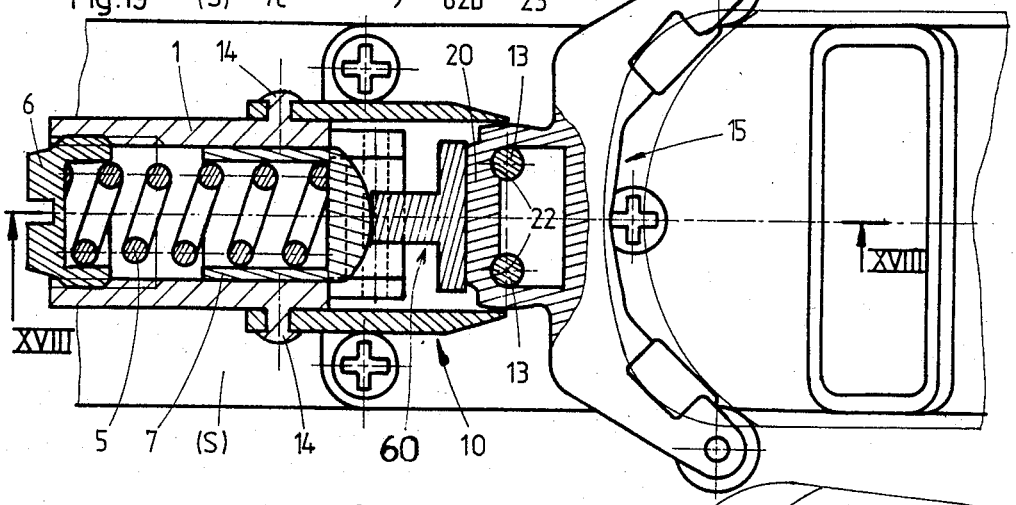
FIG. 19 is a top view taken in section along the plane XIX—XIX of FIG. 18.

In the normal position shown in FIGS. 18 and 19, the spring 5 applies the piston 7 against the lever 60. This lever bears against the flat front face **20*a* of the jaw unit 15 and exerts a rearward thrust on said front face in order to ensure that the grooves 22 are powerfully applied against the rods 13**.

In this position, the roller 23 is located within the hollowed-out portion **62*b*** and is only in very light contact with the top wall of said hollowed-out portion.

Figure 20:
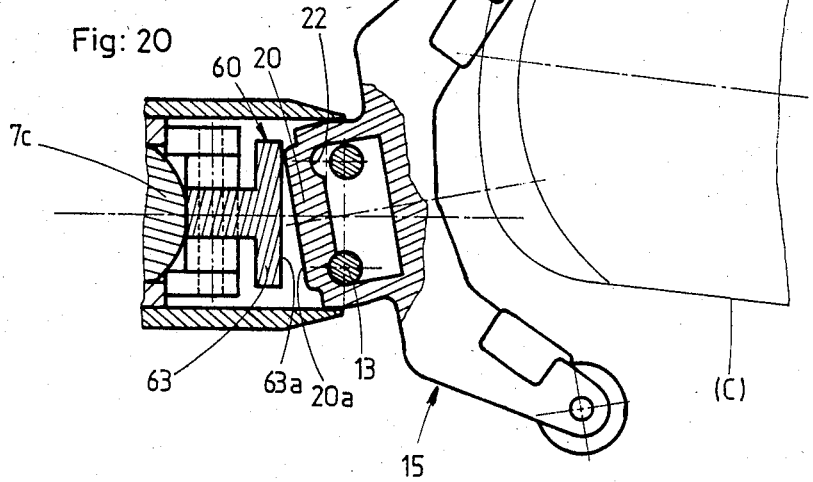
FIG. 20 is a fragmentary view which is similar to FIG. 19 and shows the abutment device in a torsional release position.

In the event of a simple twisting movement as illustrated in FIG. 20, the jaw unit 15 pivots about one of the rods 13 and, by means of one of the edges of the flat front face **20*a*, exerts a forward thrust on the lever 60 and the piston 7**.

It is the relatively substantial width of the cross-bar 63 which is instrumental in determining the stiffness of torsional release.

Figure 21:
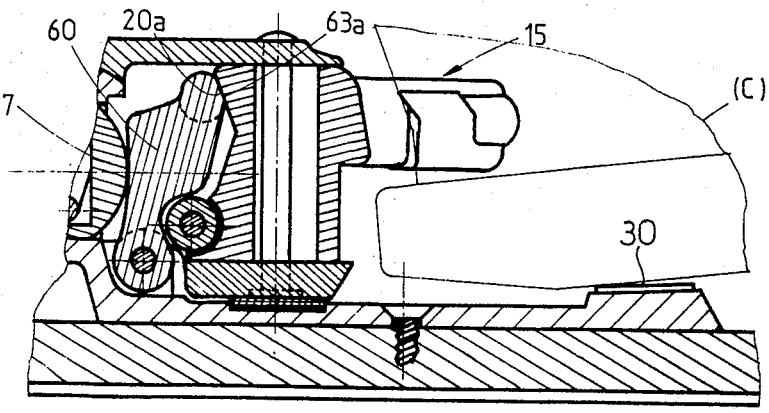
FIG. 21 is a fragmentary view which is similar to FIG. 18 and shows the abutment device when subjected to a longitudinal thrust.
Figure 22:
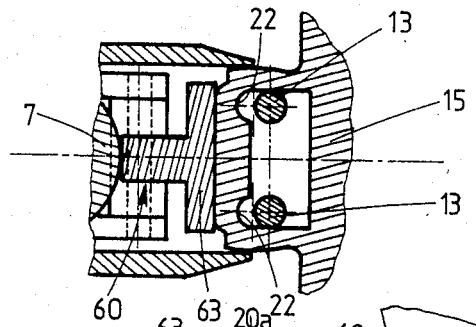
FIG. 22 is a fragmentary view which is similar to FIG. 19 and also illustrates said longitudinal thrust.
Figure 23:
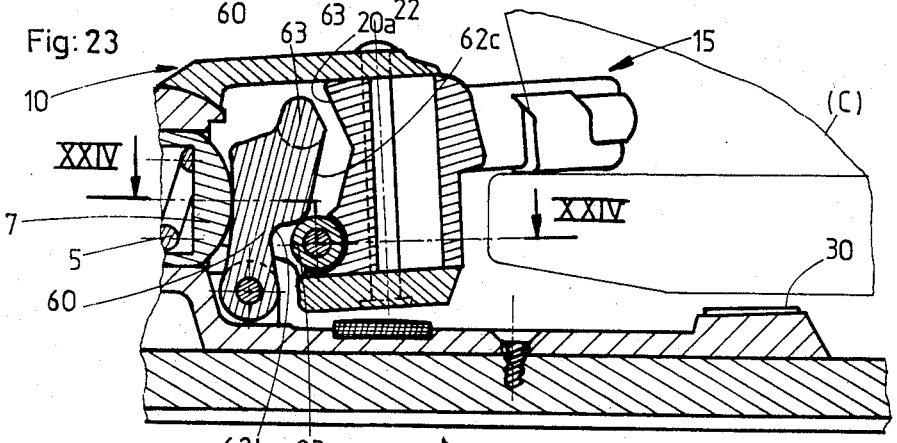
FIG. 23 is a fragmentary view which is similar to FIG. 18 and shows the abutment device when subjected to a backward-fall displacement.
Figure 24:
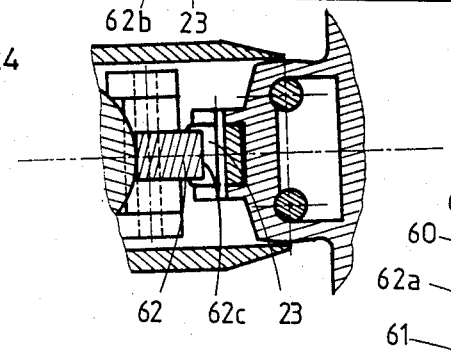
FIG. 24 is a fragmentary view taken in section along the staggered plane XXIV—XXIV of FIG. 23.

In the event of a longitudinal thrust exerted by the ski boot, in particular as a result of a forward fall, the jaw unit 15 slides forward within the yoke 10 and the grooves 22 move away from the rods 13 (as shown in FIGS. 21 and 22). During this movement, the flat front face **20*a* again exerts a forward thrust on the lever 60 and the piston 7**.

The initial freedom of pivotal displacement of the jaw unit as obtained by virtue of the withdrawal of the grooves 22 with respect to the rods 13 results in compensation for the parasitic friction forces, which was the objective to be accomplished in combined falling movements involving forward-fall and twisting.

In the event of a backward fall, the assembly consisting of jaw unit 15 and yoke 10 undergoes an upward displacement in pivotal motion about the pivots 14. As it moves upward, the roller 23 encounters the edge of the hollowed-out portion **62*b* and causes the lever 60 to pivot and exert a forward thrust on the piston 7. As the roller 23 continues to move upward, it runs along the guide ramp 62*c* while continuing to thrust forward the assembly consisting of lever 60 and piston 7 as well as to compress the spring 5**.

During this movement, the upper end of the lever 60 formed by the cross-bar 63 moves away from the flat front face 20*a*. Torsional locking of the jaw unit 15 is therefore achieved as a result of cooperation of the roller 23 with the guide ramp 62*c* of small width, that is to say with a distinctly lower value of stiffness than the initial value. There is thus obtained a compensation for parasitic friction forces arising from a combined forward-fall and twisting movement.

In the embodiments which have just been described, the different leverage effects which govern the torsional and backward-fall trips are so determined that the ratio of the backward-fall tripping force F(V) to the twisting-movement tripping force F(H) is of the order of 5 to 6. This ratio makes it possible to ski with complete safety without any risk of accidental trips.

In these embodiments, a complete backward-fall release or trip has been contemplated, that is to say the possibility of upward escape of the ski boot. However, it will be readily apparent that a toe-abutment device which has the same characteristics but is provided with a limited range of travel under backward-fall conditions (and does not permit the aforementioned vertical escape) would not constitute a departure from the scope of the present invention.

For the sake of simplification, the height-adjustment system of the toe-abutment device which permits adaptation of said device to soles having different thicknesses has not been illustrated since it has no direct bearing on the invention. A system of known type could be provided for this purpose and could thus be incorporated either in the jaw unit 15 or in the base plate 2, thereby permitting vertical displacement of the slide plate 30.

Again for the purpose of simplification, the stiffness display device for providing a visual indication of the degree of compression of the spring 5 is not shown in the drawings.

The locking lever (or levers) could be pivoted about a shaft which is mounted, not in the base plate 2 of the body 1, but on the contrary within the upper portion of this latter. It would be possible to design the jaw unit 15 so that it cooperates with the sole of the ski boot instead of the boot-upper. Furthermore, it would be possible to replace the two rods 13 by a single vertical cross-plate which is intended to cooperate with the front wall of the opening 21.

Finally, although the safety ski binding described in the foregoing has been designed to retain the toe end of the ski boot, it would be possible to contemplate its use as a heel-holding device providing trips under conditions of forward-fall and twisting movements. To this end, it would only be necessary to replace the jaw unit by a heel-clamping member of suitable shape.

What is claimed is:

1. A safety ski binding comprising a hollow body to be mounted on a ski, a yoke pivoted on said body about a horizontal cross-pin which extends transversely with respect to the ski, a boot-retaining jaw unit carried by the yoke and capable of lateral pivotal displacement on each side of the axis of the ski, a locking lever mounted within said body and pivoted about a horizontal cross-pin which extends transversely with respect to the ski, a spring housed within said body and adapted to produce action in opposition to the locking lever so as to ensure that said lever prevents lateral pivotal displacement of the jaw unit while at the same time preventing upward displacement of the assembly consisting of said jaw unit and said yoke by means of a guide ramp, wherein the jaw unit is guided in sliding motion within the yoke in the longitudinal direction of the ski and wherein said jaw unit is normally maintained stationary and prevented from moving in a lateral direction by two bearing means which are associated with said jaw unit and complrise:

a first bearing means directed toward the ski boot and adapted to cooperate with a first complementary support which is rigidly fixed to the yoke; and a second bearing means directed away from the ski boot and adpated to cooperate with a second complementary support which is rigidly fixed to the locking lever; said first bearing means comprising a pair of vertical grooves cut in the jaw unit symmetrically with respect to the axis of the ski, said first support comprising a pair of vertical cylindrical rods attached to the yoke and spaced at a distance from each other which corresponds to the distance between said grooves, the jaw unit having a front extension on the side remote from the ski boot, said extension having a vertical opening having an approximately rectangular contour and traversed by said vertical cylindrical rods, and said grooves being cut in that wall of said opening which is located on the side remote from the ski boot.

2. A safety ski binding according to claim 1, wherein said binding is provided with a third movable support which is urged by the spring toward the jaw unit and is smaller in width than the second support, said third support being adapted to cooperate with a third bearing means mounted in fixed relation to said jaw unit when the assembly consisting of jaw unit and yoke is upwardly displaced under the action of a vertical force.

3. A safety binding according to claim 2, wherein the third support is designed in the form of an inclined guide ramp which produces action against said third bearing means in order to prevent upward displacement of the assembly consisting of jaw unit and yoke.

4. A safety binding according to claim 3, wherein said third bearing means is a roller which is freely mounted for rotation on a horizontal cross-pin carried by the jaw unit.

5. A safety binding according to claim 2, wherein said second and third bearing means mounted in fixed relation to the jaw unit are constituted by a single element.

6. A safety binding according to claim 2, wherein the second and third bearing means associated with the yoke are separate and distinct means.

7. A safety binding according to claim 2, wherein the third support is carried by the locking lever.

8. A safety binding according to claim 2, wherein the third support is carried by a second lever pivotally mounted on a horizontal cross-pin which extends transversely with respect to the ski.

9. A safety binding according to claim 8, wherein the second lever is pivotally mounted on the same cross-pin as the locking lever.

10. A safety binding according to claim 1, wherein said binding is provided with means for attenuating the frictional contact of the ski boot with the boot-retaining jaw unit and wherein said means are constituted by the combination of a pair of slip linings and a pair of guide rollers mounted on the jaw unit symmetrically on each side of the axis of the ski.

11. A safety binding according to claim 10, wherein said means for attenuating frictional contact are so arranged that the guide rollers alone are applied against the ski boot in the normal position, the slip linings being applied against the ski boot as a result of penetration of said boot into the jaw unit under a longitudinal thrust force of substantial magnitude.

12. A safety binding according to claim 1, wherein said binding is provided with a resilient shock-absorbing buffer mounted in the base plate of the stationary hollow body and adapted to serve as a stop for the articulated assembly consisting of yoke and jaw unit when said assembly moves down against the ski after disengagement of the ski boot.

* * * * *